US005927902A

United States Patent [19]

Sveen et al.

[11] Patent Number: 5,927,902

[45] Date of Patent: Jul. 27, 1999

[54] DEVICE FOR SUSPENDING FLEXIBLE AND SEMI-FLEXIBLE PIPES ON STRUCTURES AT SEA

[75] Inventors: Dagfinn Sveen, Oslo; Steinar Wighus, Slemmestad, both of Norway

[73] Assignee: Norsk Hydro Asa, Oslo, Norway

[21] Appl. No.: 08/869,413

[22] Filed: Jun. 4, 1997

[30] Foreign Application Priority Data

Jun. 5, 1996 [NO] Norway ..... 962352

[51] Int. Cl.[6] ..... F16L 1/04; F16L 3/16

[52] U.S. Cl. ..... 405/169; 137/615; 141/387; 166/359; 405/195.1

[58] Field of Search ..... 405/224, 210, 405/195.1, 169, 170; 141/387; 166/350, 359; 137/615

[56] References Cited

U.S. PATENT DOCUMENTS

| | | | |
|---|---|---|---|
| 3,176,730 | 4/1965 | Knight | 141/290 |
| 3,700,014 | 10/1972 | Scales et al. | 405/201 X |
| 3,805,834 | 4/1974 | Bily | 137/615 |
| 4,029,126 | 6/1977 | Miyazaki et al. | 137/615 |
| 4,067,202 | 1/1978 | Reed | 166/359 X |
| 4,279,543 | 7/1981 | Remery | 405/210 X |
| 4,301,840 | 11/1981 | Jansen | 141/387 X |
| 4,699,191 | 10/1987 | Pollack et al. | 141/387 X |
| 4,741,716 | 5/1988 | Hasebe et al. | 141/387 X |
| 5,488,980 | 2/1996 | Krogstad et al. | 141/387 |

*Primary Examiner*—Dennis L. Taylor
*Attorney, Agent, or Firm*—Wenderoth, Lind & Ponack, L.L.P.

[57] ABSTRACT

A device for connection or suspension between a detachable flexible or semi-flexible riser pipe (4) and a pipe system (14) on a fixed or floating platform or ship (15) has a rotary connection which is designed in such a way that the connection between the riser pipe (4) and the pipe system (14) is moment-free or mainly moment-free. The rotary connection may appropriately have a swivel housing (3) which, on one side, is fitted with a first tubular shaft (1) which is connected to the pipe system (14) on the platform or ship and, on the other side, is fitted with a second tubular shaft (2) which is arranged in a swivel housing at an angle of 90° to the first tubular shaft (1) and which is connected to the riser pipe (4). The two shafts (1, 2) communicate with each other via a cavity in the swivel housing (3), but are closed to the surroundings at their ends.

23 Claims, 7 Drawing Sheets

DEVICE FOR SUSPENDING FLEXIBLE AND SEMI-FLEXIBLE PIPES ON STRUCTURES AT SEA

BACKGROUND OF THE INVENTION (1) Field of the Invention

The present invention concerns a device for connection or suspension between a detachable flexible or semi-flexible riser pipe and a pipe system on a fixed or floating platform or ship, which riser pipe is designed to transfer oil and/or gas and extends from a connection point on the sea bed to the platform or ship.

(2) State of the Prior Art

As oil and gas fields at great depths of the sea are developed, installations will increasingly be floating structures such as platforms, which move under the influence of waves, wind and currents. This means that the pipes which are linked to production and injection wells on the sea bed must be sufficiently flexible and strong to be able to move with the platform on the surface. For this purpose, special flexible riser pipes have been developed which withstand high pressure and have relatively high bending flexibility. As the movements and wave forces are greatest at the surface, the pipe is also exposed to the greatest bending stresses in this area. In particular, the stress will be great where the flexible pipe is connected to the platform, as this point is very stiff in relation to the pipe.

Various principles have been elaborated to limit the bending stresses at the suspension point of the pipe. One method which is widely used involves the use of a stiff guide pipe through the wave zone through which the flexible pipe passes. In order to limit the bending stress on the flexible pipe at the entrance to the guide pipe, the latter is provided with a trumpet-shaped end piece which controls the bending radius of the flexible pipe when it lies against the wall on the inside. In this way, the bending stress on the flexible pipe can be reduced by means of the shape of the trumpet-shaped end piece.

A more simple arrangement involves suspending the pipes freely from the deck. This produces high wave stresses on the pipes and it is particularly important to limit the resulting bending moments where the pipe is fastened to the deck. In such arrangements, it is common to use so-called bending limiters. These are specially manufactured flexible pipe sections which are placed outside the flexible pipe and which limit the bending radius of the flexible pipes with a precisely stepped bending stiffness. However, none of these solutions provide satisfactory security against overstressing, and thus the risk of breaking, when the bending stiffness of the pipe exceeds a certain magnitude.

Today, there are thus solutions for suspending "standard" flexible pipes from floating platforms. However, standard flexible pipes also have limitations regarding pressure and temperature, so that for some oil and gas fields it is very unfavourable or impossible to use this type of pipe. One possible solution is to use semi-flexible pipes. This means pipes which are made of metals with a low Young's modulus and a high tensile strength, such as titanium. These pipes will have acceptable stress tolerance in the area between the sea bed and the platform under the influence of waves and movement, but on account of the relatively high bending stiffness, it will be difficult or impossible to achieve an acceptable level of stress tolerance in the connection to the platform with the solutions described for standard flexible pipes.

SUMMARY OF THE INVENTION

With the present invention, a device for suspending detached flexible or semi-flexible riser pipes from fixed and floating platforms has been arrived at which does not absorb bending stresses and which thus does not expose the pipe to the risk of breaking. The solution is thus much safer than the solutions known previously. Furthermore, it is easy and cheap and takes up little space. At the same time, it offers the opportunity of connecting equipment for maintenance and cleaning, i.e. a so-called cleaning plug.

The present invention is characterised in that a suspension system comprises a rotary connection which is designed in such a way that the connection between the riser pipe and the pipe system on the platform or ship is moment-free or almost moment-free.

The present invention primarily concerns a connecting device for connection between a detachable riser pipe that is at least partly flexible for transferring petroleum fluids from a connection point on the sea bed and a pipe system on a structure above the connection point on the sea bed. The connecting device includes a fluid inlet side, a fluid outlet side and a rotary fluid connection between the inlet and outlet sides. The rotary fluid connection is arranged such that a force acting on the riser pipe, when connected at the fluid inlet side, establishes substantially no moment between the inlet side and the fluid outlet side.

The rotary fluid coupling, put another way, couples a first pipe to a second pipe while preventing the establishment of the moment due to a force on the first pipe. A swivel housing is preferably provided, having a fluid inlet side and a fluid outlet side. A first conduit forms a rotary and fluid connection on the fluid inlet side of the swivel housing for rotatably and fluidly connecting the first pipe with the swivel housing. A second conduit forms a rotary and fluid connection in the fluid outlet side of the swivel housing for rotatably and fluidly connecting the second pipe with the swivel housing. The first and second fluid conduits are fluidly communicated with each other through the swivel housing, and the first and second fluid conduits form rotary connections that allow for rotation about respective axes that are perpendicular to each other as seen in a direction perpendicular to both axes.

Thus, the present invention provides a means for connecting a riser pipe with a pipe system by a rotary and fluid connection such that forces acting on the riser pipe as a moment arm establishes substantially no moment between the riser pipe and the pipe system.

BRIEF DESCRIPTION OF THE DRAWINGS

The present invention will be described in further detail in the following by means of examples and with reference to the drawings, where.

DETAILED DESCRIPTION OF THE PREFERRED EMBODIMENT

Figure 1:
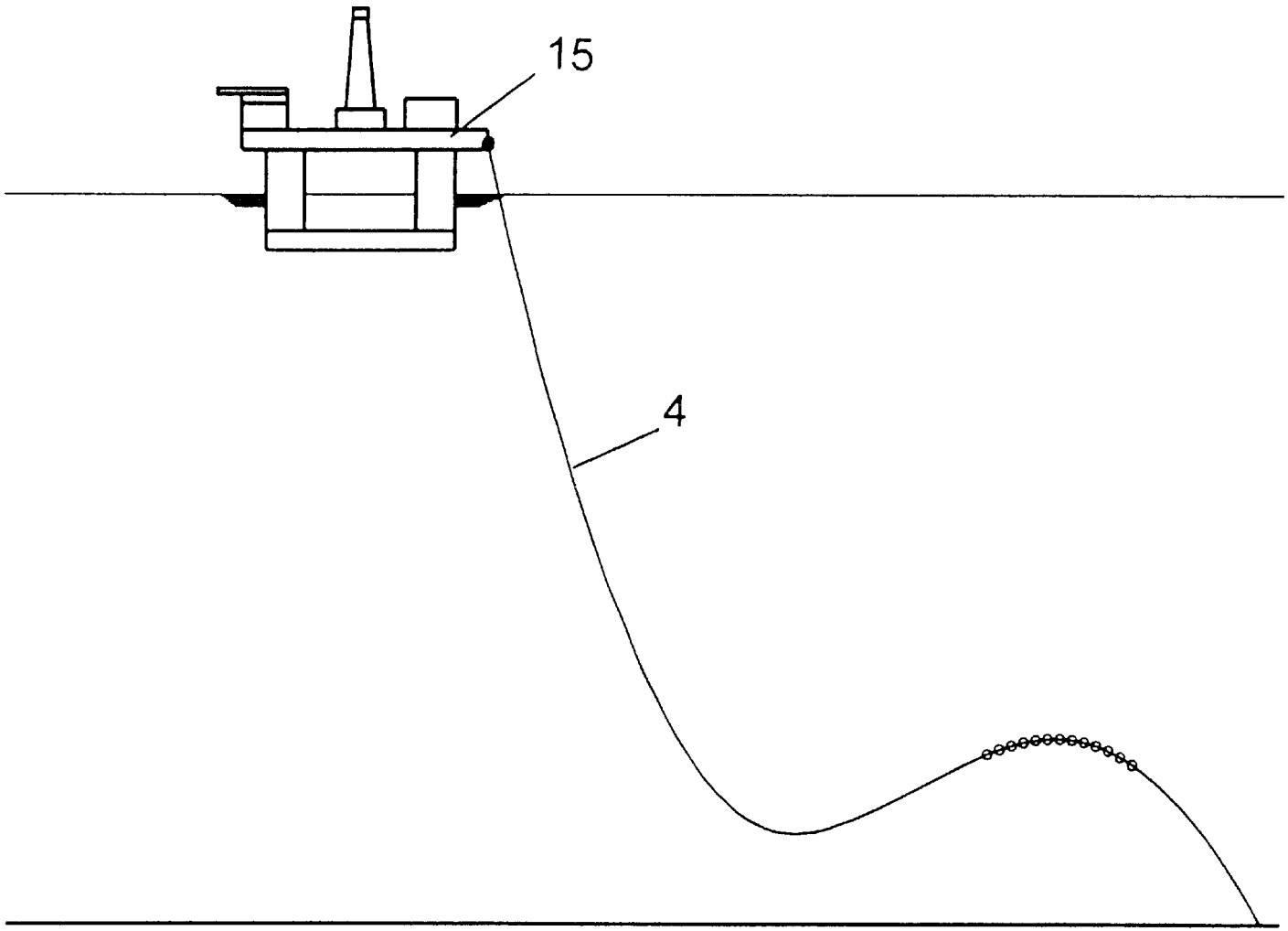
FIG. 1 shows an example of a flexible or semi-flexible riser pipe.

As shown in FIG. 1, a device in accordance with the present invention concerns a suspension or connection system between a flexible or semi-flexible riser pipe 4 and a fixed or floating platform or ship 15 on the surface of the sea.

Figure 2:
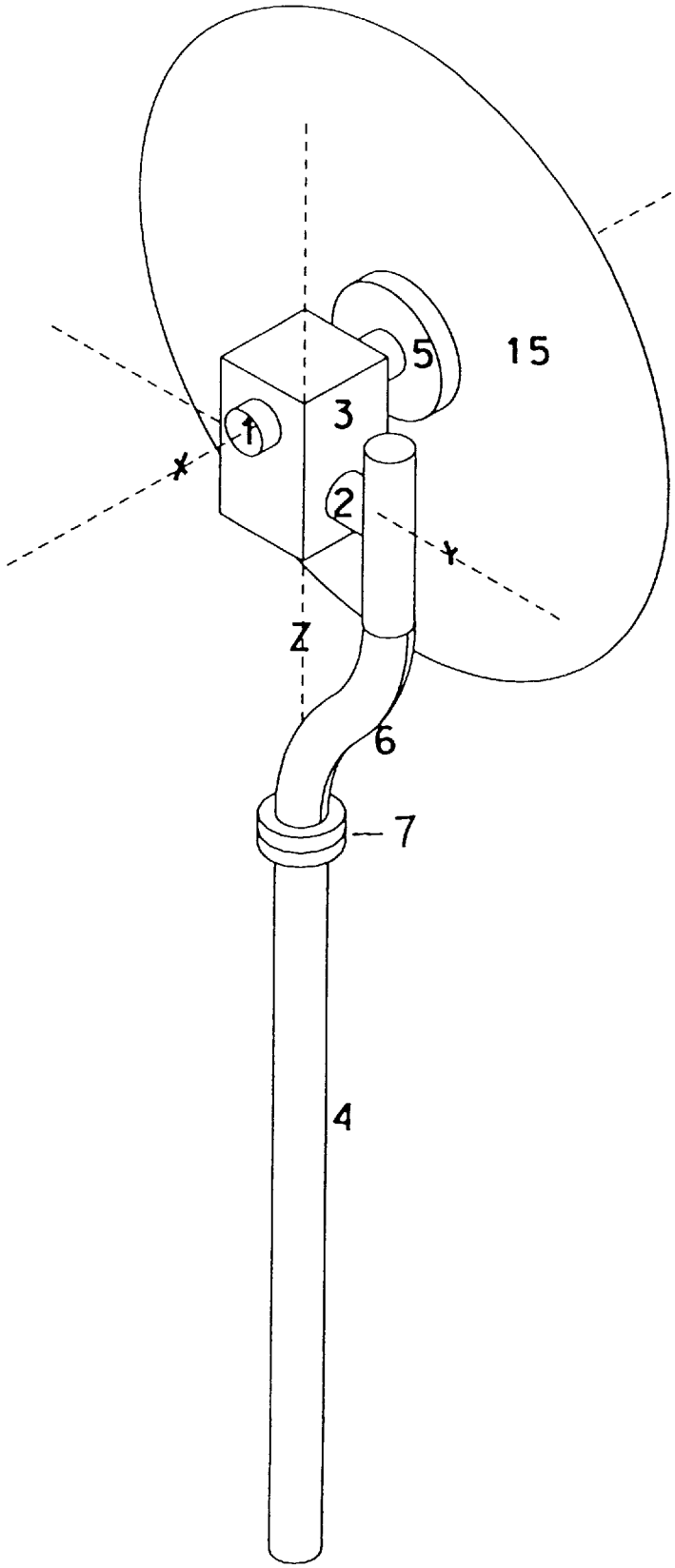
FIGS. 2–4 show the present invention seen, respectively, in perspective, from the side and from the front.
Figure 3:
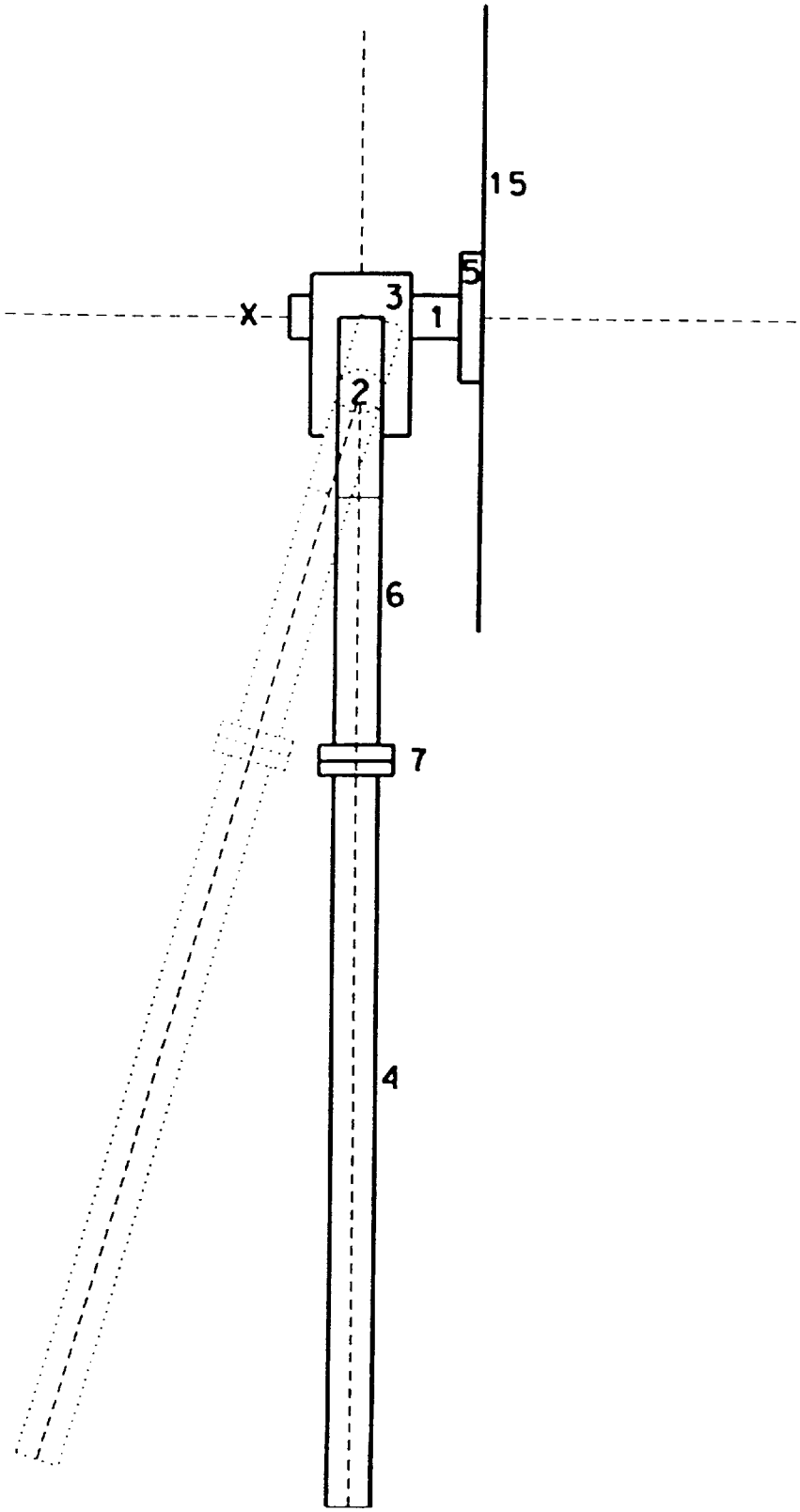
Figure 4:
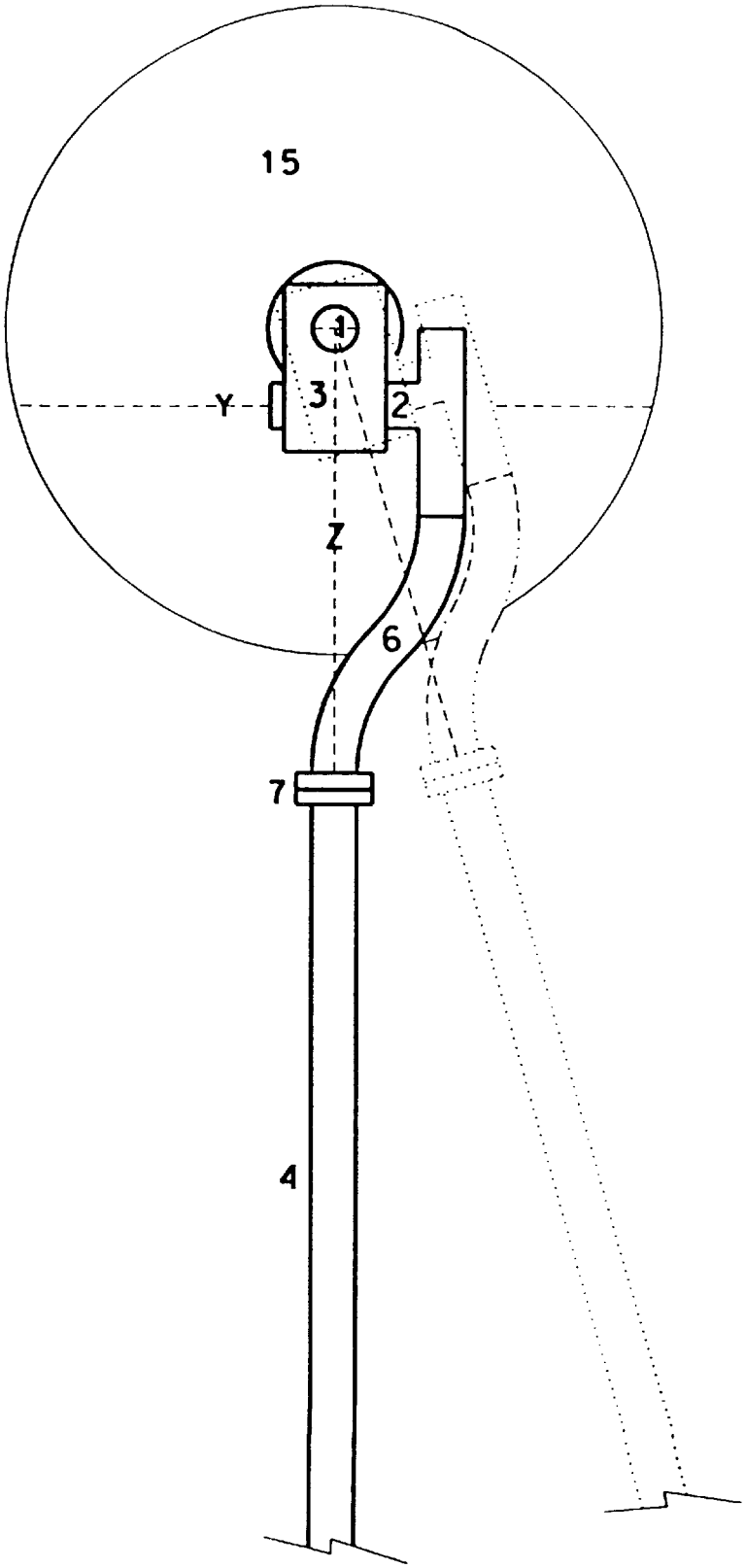

As shown in FIGS. 2–4, a suspension or connection system consists of a bearing or swivel housing 3. One side of the housing is supported around a first tubular shaft 1 which extends in the x direction perpendicularly towards, and is connected, via a flange 5 or the like to, to a pipe system on the platform 15. On the other side the housing 3 is fitted with another tubular shaft 2 which can be rotated around the Y axis, is arranged in the swivel housing 3 and is connected to the riser pipe 4 via a pipe section 6 and a flange connection 7.

Figure 5:
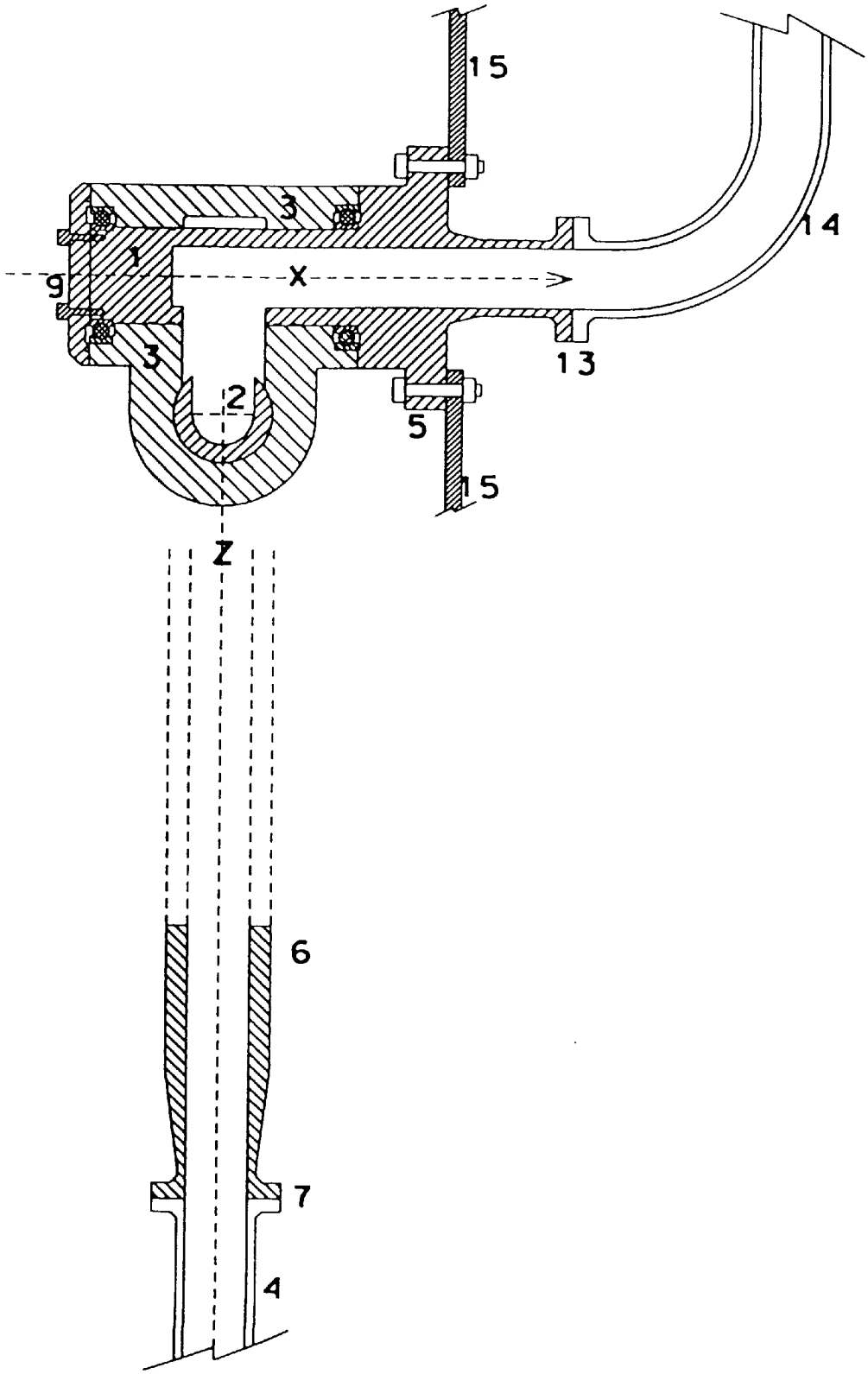
FIGS. 5 and 6 show a vertical section along the X/Z axis and the Y/Z axis, respectively, for the solution shown in FIGS. 2–4.
Figure 6:
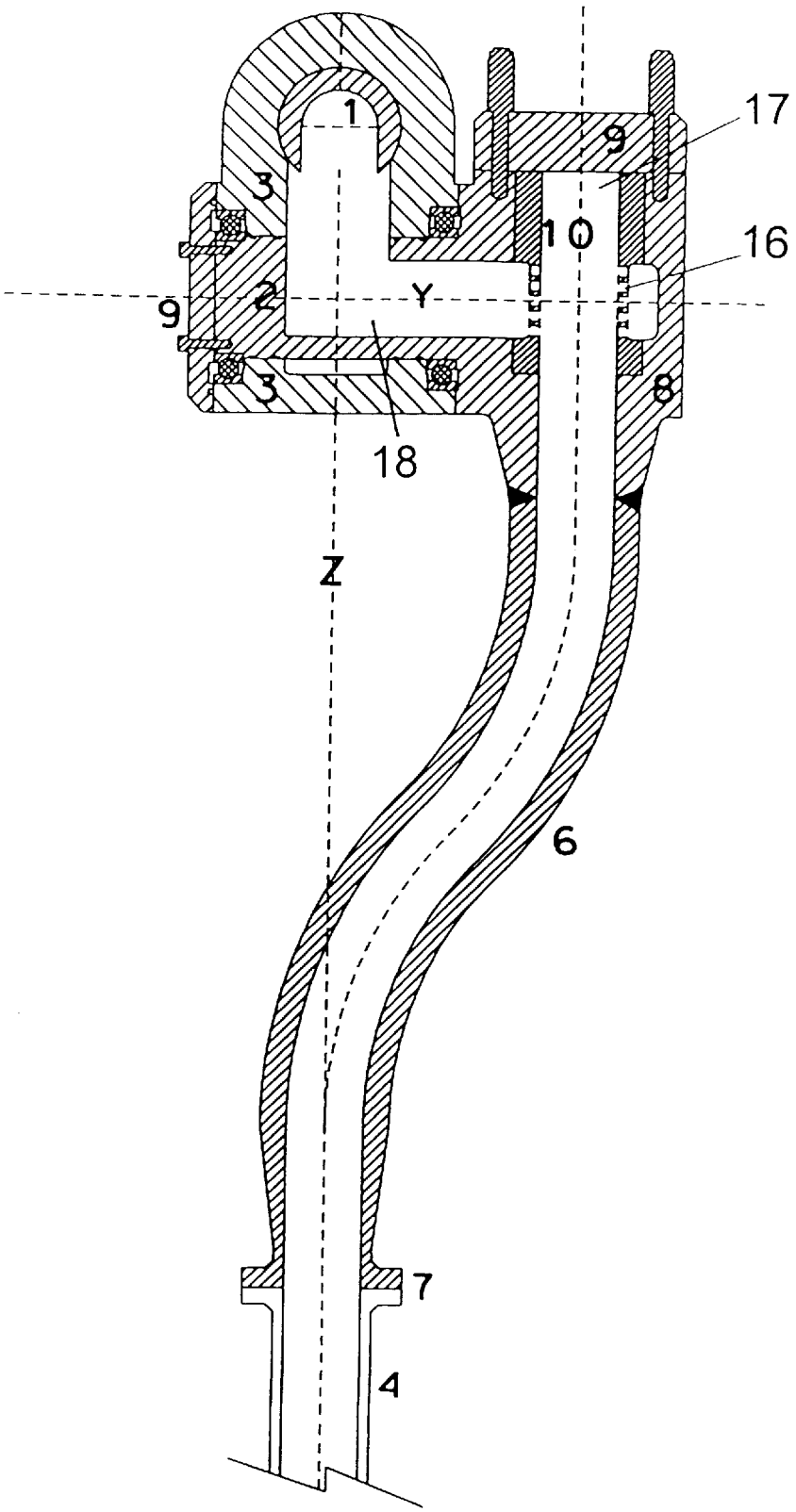

With this solution, the pipe 4 can simultaneously swivel in two planes perpendicular to one another as shown in the figures. To the extent to which shafts 1 and 2 are free to rotate, depending on the friction in the bearings, the device will be moment-free around the axes X and Y. This means that the resultant of the forces from the flexible pipe will traverse axes X and Y. In order for the flexible pipe 4 to be moment-free in its connection to the device, the connection point must be located geometrically so that a hypothetical extension of the flexible pipe's axis Z traverses axes X and Y. In this way, no eccentric moments will occur in the flexible pipe at the point of connection. In order to achieve this, a pipe section 6 is arranged on the device. The pipe section 6 at its lower end, represents the mounting point for the flexible pipe 4, preferably with the flange connection 7, and, at its upper end, the pipe section 6 is connected to the shaft 2. The pipe section 6 is curved so that the geometric location requirement of the mounting point for the flexible pipe 4, as described above, is met. The transfer of gas/liquid from the flexible pipe through the suspension device to a fixed pipe connection on the platform is to be explained with reference to FIGS. 5 and 6.

With this arrangement, the bearing of swivel housing 3 forms a rotary fluid connection that includes a first pivotal fluid coupling permitting pivotal movement of the fluid inlet side of the connection by the first horizontal axis relative to the fluid outlet side of the housing. Further, a second pivotal fluid coupling is part of the rotary fluid connection and permits pivotal movement of the fluid inlet side about a second horizontal axis perpendicular to the first axis relative to the fluid outlet side. In other words, the first and second axes are the X and Y axes. Thus, an extension of the Z axis of the riser pipe passes through both the first and second axes to establish substantially no moment between the fluid inlet and outlet sides.

The oil or gas fluid passes from the flexible pipe 4 through the pipe section 6 and into a transition channel 8 in the bearing/swivel housing 3. Here the medium passes into the shaft 2, which is hollow. The shaft, which is sealed at its other end, has a side opening in its central area so that the media can pass into the bearing/swivel housing 3. The bearing/swivel housing 3 has an internal channel which transfers the medium to a side opening in shaft 1, which, like shaft 2, is hollow and sealed at the free end. The medium passes through shaft 1 to a pipe 14 on the platform. Pipe 14 is preferably connected to shaft 1 with a flange connection 13 at the end of the shaft. Shafts 1 and 2 thus function as a double swivel system together with the bearing/swivel housing 3.

In order to avoid axial compressive forces between shafts 1 and 2 and the swivel housing 3, the shafts are continuous and sealed at their outer ends. This means that the shafts must be offset vertically so that they do not touch one another. In order to avoid the shafts being pulled out, they are provided at the end with a bolted bearing plate 9 which will lie against the housing.

In order for it to be possible to send a cleaning plug through the transition channel 8, via the pipe section 6 and through the flexible pipe 4, the transition channel 8 is provided with an opening in its upper end in the extension axis to pipe section 6. It is possible to connect a cleaning plug sluice to the opening using a bolted flange connection. When the cleaning plug sluice is not used, the opening at the top of the transition housing will be closed with a blind flange 9.

The shaft 2, which passes from the transition channel 8 and into the bearing/swivel housing 3, is, as described earlier, hollow. This horizontal channel in the shaft will pass laterally into the vertical channel which extends from the pipe section and up to the opening for the cleaning plug. In order for this channel opening not to disturb or make difficult the passage of the cleaning tool, a vertical sleeve 10 is placed through this area in the transition section. The sleeve has a number of small openings in the wall so that the cleaning tool can pass unobstructed. The total area of the openings is sufficient for the medium to pass unobstructed.

A further requirement in connection with the use of the cleaning plug is that the curvature of the pipe section 6 does not have too small bending radii, which is taken into consideration in the design of the structure. The pipe section 6 will be exposed to large bending moments in its upper end as a result of the eccentricity in the load when the pipe is bent away from the axis at the mounting point of the flexible pipe 4. This is taken into consideration in the dimensioning of the wall thickness of the pipe section.

Figure 7:
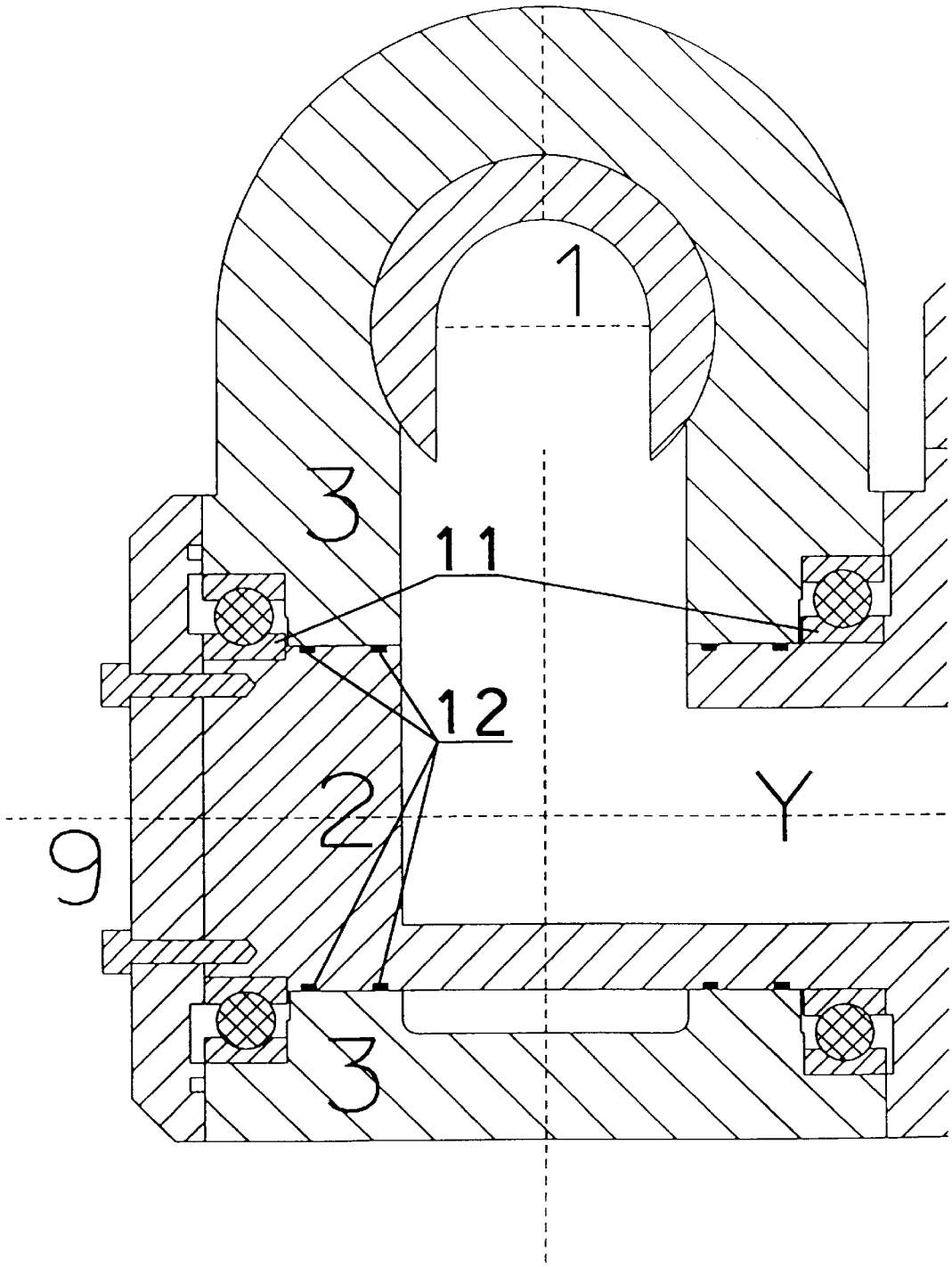
FIG. 7 shows, in larger scale, a part of the solution shown in FIG. 6.

The swivel housing 3 with bearing and seals is shown in larger scale in FIG. 7. As can be seen, the shaft 2 is supported on bearings 11 in two places, at its inner and outer ends on each side of the side openings. The bearings 11 can be either sliding bearings or roller/ball bearings. Between the bearings and the side openings in the shaft, gaskets 12 will be arranged in grooves in the shafts between the shaft and the boring in the swivel housing. An equivalent bearing and gasket solution is used for shaft 1.

Regarding the swivel housing 3, the shafts 1 and 2 and the bearing support of the shafts, the present invention as it is defined in the claims is not limited to the design shown in the figures and described above. Thus, can the two shafts 1 and 2 can, instead of being supported on bearings in the swivel housing 3 at one of their ends and permanently connected to the platform 15 and the riser pipe at their other ends, can be permanently connected to the swivel housing at one of their ends and connected in rotary fashion at their other ends to the platform and riser pipe, i.e. the opposite of that which is shown in the drawings.

We claim:

1. A connecting device for connection between a detachable riser pipe that is at least partly flexible for transferring petroleum fluids from a connection point on the sea bed and a pipe system on a structure above the connection point on the sea bed, said connecting device comprising a fluid inlet side, a fluid outlet side and a rotary fluid connection between said fluid inlet side and said fluid outlet side said rotary fluid connection comprising a first pivotal fluid coupling permitting pivotal movement of said fluid inlet side about a first horizontal axis relative to said fluid outlet side and a second pivotal fluid coupling permitting pivotal movement of said fluid inlet side, about a second horizontal axis perpendicular to said first axis, relative to said fluid outlet side such that horizontal forces acting on a riser pipe, when connected at said fluid inlet side so that an extension of an axis of the riser pipe passes through both said first and second axes, establish substantially no moment between said fluid inlet side and said fluid outlet side.

2. The connecting device of claim 1, wherein said rotary fluid connection comprises a swivel housing that is fitted, at said fluid outlet side, with a first tubular shaft for connection with the pipe system to form said first pivotal fluid coupling and, at said fluid inlet side, with a second tubular shaft extending perpendicularly to said first tubular shaft to form said secon pivotal fluid coupling, said first and second tubular shaft communicating with each other through a cavity in said swivel housing and having closed ends.

3. The connecting device of claim 2, wherein each of said first and second tubular shafts, at one end thereof, is rotatably disposed in said swivel housing.

4. The connecting device of claim 2, wherein said first and second tubular shafts are permanently connected to said swivel housing at first ends of said first and second shafts and comprise rotary connections at opposite ends of said first and second shafts for rotary connection to the pipe system and the riser pipe.

5. The connecting device of claim 2, wherein said first and second shafts are vertically offset with respect to each other.

6. The connecting device of claim 2, wherein each of said first and second shafts is supported in roller bearings disposed at outer sides of said swivel housing.

7. The connecting device of claim 2, wherein said second tubular shaft is fluidly connected with a pipe link that bends so as to extend vertically underneath said swivel housing and extend along a z axis which traverses axes of said first and second tubular shafts.

8. The connecting device of claim 2, wherein said second tubular shaft comprises an inlet part including an internal sleeve having a plurality of perforations therein.

9. The connecting device of claim 8, wherein said inlet part comprises an opening having a removable blind flange such that a cleaning device can be introduced through said opening.

10. A fluid connecting system comprising:

a detachable riser pipe that is at least partly flexible for transferring petroleum fluids from a connection point on the sea bed;

a pipe system on a structure above the connection point on the sea bed; and a connecting device comprising a fluid inlet side fluidly connected with said riser pipe, a fluid outlet side fluidly connected with said pipe system, and a rotary fluid connection between said fluid inlet side and said fluid outlet side, said rotary fluid connection comprising a first pivotal fluid coupling permitting pivotal movement of said fluid inlet side about a first horizontal axis relative to said fluid outlet side and a second pivotal fluid coupling permitting pivotal movement of said fluid inlet side, about a second horizontal axis perpendicular to said first axis, relative to said fluid outlet side such that horizontal forces acting on said riser pipe, which is connected so that an extension of an axis of the riser pipe passes through both said first and second axes, establish substantially no moment between said riser pipe and said pipe system.

11. The fluid connecting system of claim 10, wherein said rotary fluid connection comprises a swivel housing that is fitted, at said fluid outlet side, with a first tubular shaft connect with said pipe system to form said first pivotal fluid coupling and, at said fluid inlet side, with a second tubular shaft extending perpendicularly to said first tubular shaft to form said second pivotal fluid coupling and connected with said riser pipe, said first and second tubular shafts communicating with each other through a cavity in said swivel housing and having closed ends.

12. The fluid connecting system of claim 11, wherein each of said first and second tubular shafts, at one end thereof, is rotatably disposed in said swivel housing, said first tubular shaft is fixed to said structure at the other end thereof, and said second tubular shaft is fixed to said riser pipe at the other end thereof.

13. The fluid connecting system of claim 11, wherein said first and second tubular shafts are permanently connected to said swivel housing at first ends of said first and second shafts and are rotatably connected at opposite ends thereof to said pipe system and said riser pipe, respectively.

14. The fluid connecting system of claim 11, wherein said first and second shafts are vertically offset with respect to each other.

15. The fluid connecting system of claim 11, wherein each of said first and second shafts is supported in roller bearings disposed at outer sides of said swivel housing.

16. The fluid connecting system of claim 11, wherein said second tubular shaft is fluidly connected with a pipe link that bends so as to extend vertically underneath said swivel housing and extend along a z axis which traverses axes of said first and second tubular shafts.

17. The fluid connecting system of claim 11, wherein said first tubular shaft comprises a first flange connection connecting said first tubular shaft to a wall of said structure, a fluid passage of said tubular shaft extending through said flange connection, and said first tubular shaft having a part having a diameter smaller than said flange connection which extends through said wall and connects to said pipe system with a second flange connection.

18. The fluid connecting system of claim 11, wherein said second tubular shaft comprises an inlet part including an internal sleeve having a plurality of perforations therein, said inlet part being connected to said riser pipe.

19. The fluid connecting system of claim 18, wherein said inlet part comprises an opening having a removable blind flange such that a cleaning device can be introduced through said opening.

20. A rotary fluid coupling for coupling a first pipe to a second pipe while preventing the establishment of a moment due to a force on the first pipe, said rotary coupling comprising:

a swivel housing having a fluid inlet side and a fluid outlet side;

a first conduit forming a rotary and fluid connection on said fluid inlet side of said swivel housing for rotatably and fluidly connecting the first pipe with said swivel housing; and a second conduit forming a rotary and fluid connection on said fluid outlet side of said swivel housing for rotatably and fluidly connecting the second pipe with said swivel housing;

wherein said first and second fluid conduits are fluidly communicated with each other through said swivel housing; and wherein said first and second fluid conduits form rotary connections that allow for rotation about respective axes that are perpendicular to each other as seen in a direction perpendicular to both axes.

21. The coupling of claim 20, wherein at least one of said first and second conduits comprises a tubular shaft rotatably supported in said swivel housing, a fluid passage, and an opening in said fluid passage located inside said swivel housing.

22. The coupling of claim 20, wherein at least one of said first and second conduits comprises a tubular shaft fixed with respect to said swivel housing.

23. A fluid connecting system comprising:

a detachable riser pipe that is at least partly flexible for transferring petroleum fluids from a connection point on the sea bed;

a pipe system on a structure above the connection point on the sea bed; and means for connecting said riser pipe with said pipe system with a rotary and fluid connection such that forces acting on said riser pipe as a moment arm establish substantially no moment between said riser pipe and said pipe system.

* * * * *